US006485163B1

(12) United States Patent
Hanchett

(10) Patent No.: US 6,485,163 B1
(45) Date of Patent: Nov. 26, 2002

(54) MULTI-POSITION LASER LIGHT PROJECTOR

(76) Inventor: Neville Hanchett, 790 Hampshire Rd., No. D, Thousand Oaks, CA (US) 91361

( * ) Notice: Subject to any disclaimer, the term of this patent is extended or adjusted under 35 U.S.C. 154(b) by 19 days.

(21) Appl. No.: 09/688,318

(22) Filed: Oct. 13, 2000

(51) Int. Cl.[7] ..... F21V 14/04

(52) U.S. Cl. ..... 362/259; 362/322; 362/282; 362/239

(58) Field of Search ..... 362/246, 259, 362/277, 237, 234, 282, 319, 322, 811

(56) References Cited

U.S. PATENT DOCUMENTS 3,710,098 A * 1/1973 Walden ..... 362/259
4,006,970 A * 2/1977 Slater et al. ..... 362/259
5,319,528 A * 6/1994 Raven ..... 362/259
5,418,700 A * 5/1995 Demeritt et al. ..... 362/259
5,576,901 A 11/1996 Hanchett ..... 362/811
6,190,022 B1 * 2/2001 Tocci et al. ..... 362/259

* cited by examiner

*Primary Examiner*—Laura K. Tso
(74) *Attorney, Agent, or Firm*—John E. Wagner; Robert C. Smith

(57) ABSTRACT

A laser light projector includes a housing having a plurality of apertures, a number of laser diodes and drivers mounted on said housing and aligned to direct laser light beams through the apertures, a controller connected to each driver for controlling the timing and sequence of laser light beams from the laser diodes, and a plurality of mirrors aligned to receive the laser light beams and deflect the beams in desired directions. A second embodiment includes connectors connected to the controller and utilizes plug-in modules, each including a laser diode and a driver to permit various types and numbers of laser modules to be operated by the controller.

13 Claims, 3 Drawing Sheets

10
11
12
14
16
18
20
22
24
26
32
34
36
38
40
42
44
46
48
DMX 512 INTERFACE
50
DMX CONTROLLER
52
54

MULTI-POSITION LASER LIGHT PROJECTOR

BACKGROUND OF THE INVENTION

There is a significant demand for systems using laser beams to create light shows for nightclubs and the like. One type of system used for this purpose consists of a laser generating device in combination with a plurality of motor actuated mirrors which are carefully aligned with each other and with the laser beam and timed to deflect the laser beam through several apertures as separate spots or beams of light which are deflected in many directions. Each mirror is fastened to a shaft which is attached to the motor output shaft. To achieve the desired light effect, the mirror support must be exactly perpendicular to the motor output shaft. The desired deflection of the mirror requires only a limited rotation of the motor and the mirror support operates between two spaced stops. Such light show systems have been in use for a number of years but have represented a fairly significant investment. They also have been somewhat heavy and cumbersome so that, while they can be moved from place to place, moving them requires a substantial effort.

Applicant's U.S. Pat. No, 5,576,901, describes how reductions in the weight and cost of such systems have been attained by reducing the size, weight and cost of the motors. There have, however, been disadvantages in even the latest such systems because the motor-driven mirror actuators are relatively delicate and can be knocked out of adjustment if subjected to careless handling. Also, there is a significant labor cost in initial assembly and adjustment of the motor-driven mirror actuators.

BRIEF DESCRIPTION OF THE INVENTION

Because of the substantial labor cost in getting the mirror actuators mounted and properly adjusted, applicant began to consider alternative ways of producing the desired light shows. Existing systems used one laser diode and driver to create a single. laser beam, which was deflected in various directions by causing mirrors to move in and out of the beam to deflect the beam through several apertures. This necessarily limits the display to one beam at a time, although the actuators move the mirrors quite rapidly to create a visual effect of many beams. Even with the use of a beam splitter to make more beams available, the power output per aperture is reduced, so this option is not always satisfactory.

In analyzing all cost factors, applicant concluded that although using one laser diode and driver per aperture would be expensive, it would be only slightly more expensive and probably less expensive in volume to make the system with, for example, eight laser diodes and drivers as compared with using one laser diode and driver with eight electromechanical mirror actuators, once the higher labor costs were factored in. The separate lasers and drivers can each be driven by the same commercially available DMX controller which was used to drive the mirror actuators in the prior art device described in U.S. Pat. No. 5,576,901. By using a separate laser diode and driver for each of the desired number of apertures, greater flexibility is afforded because more than one laser diode can be operating at a time and lasers of varying colors can be turned on at the same time. In addition to using lasers of different colors, other optical devices, such as color filters and diffraction grating means, can be used with any or any number of the laser beams. This makes it possible to display colors, which are a mix of the colors directly available from the individual laser diodes.

DETAILED DESCRIPTION OF THE PREFERRED EMBODIMENT

Figure 1:
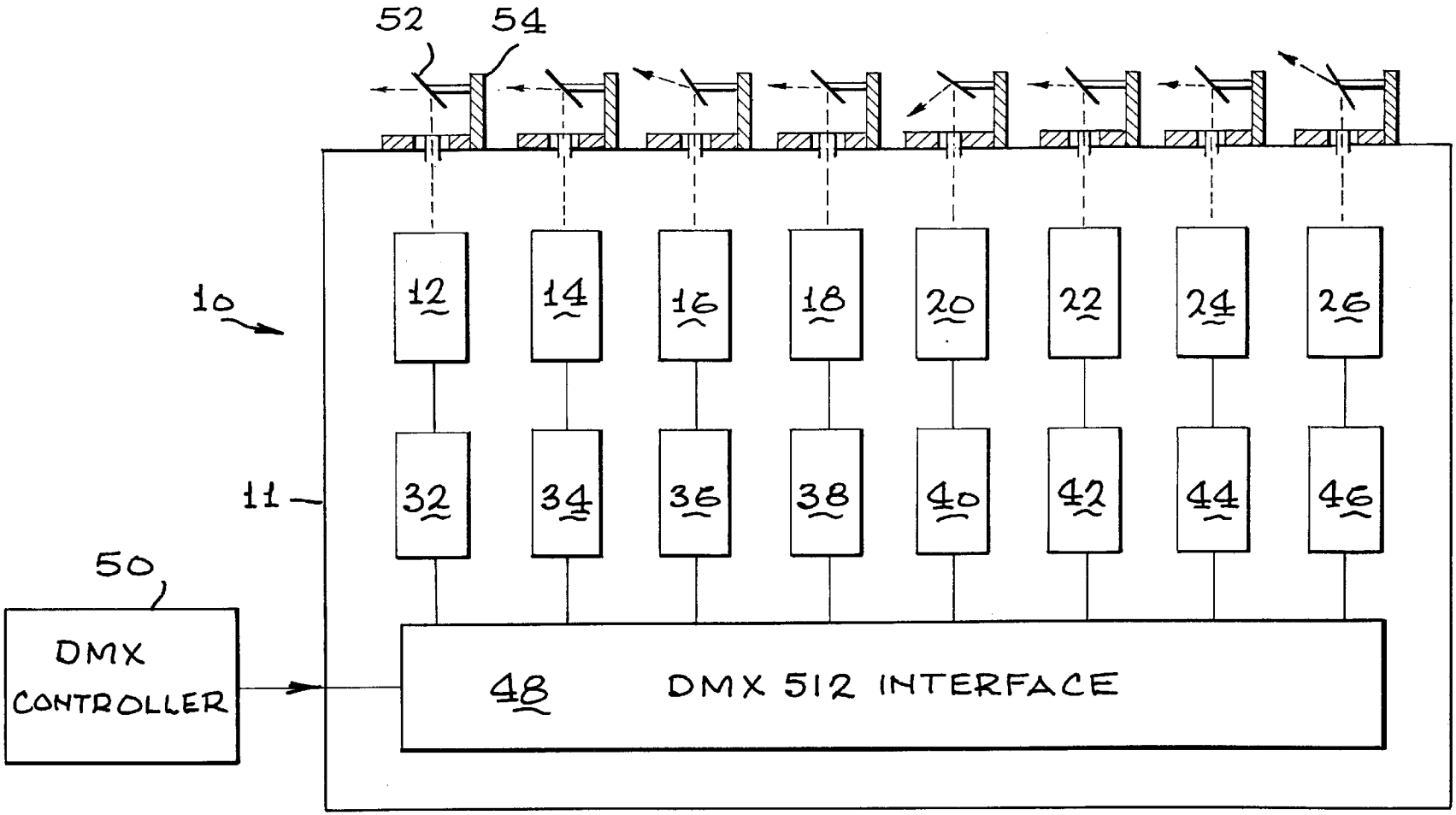
FIG. 1 is a block diagram of an eight-position projector according to the invention.

Referring to FIG. 1, an eight-position projector 10 includes a rigid frame or housing 11 having secured thereto a plurality of laser diodes 12, 14, 16, 18, 20, 22, 24, and 26. Each of the laser diodes includes a driver 32, 34, 36, 38, 40, 42, 44, and 46, respectively. While the laser diodes and drivers are, or may be commercially available units, they are not necessarily all the same since, for example, some lasers may emit red beams and others may emit green beams, and the drivers for each may be somewhat different.

Each of drivers 32 through 46 is connected to an interface device 48, which may be a DMX-512 interface, which is a commercially available device. This interface device is, in turn, driven by a controller 50 which may be a commercially available DMX controller. The DMX controller is available from NSI Corp., 9126 Southwest Ridder Road, Wilsonville, Oreg. 97070. The DMX-512 interface device is available from Doug Fleenor Design, 396 Corbett Canyon Rd., Arroyo Grande, Calif. 93420. The laser diodes 12 through 26 each emit a beam of laser light which passes through an aperture in frame 11 which impinges on an adjustable mirror 52 in one of eight identical sub-frame members 54, shown partly in section, which are secured to frame 11. Mirrors 52 are individually adjustable to direct the laser beams at various angles. Any of the sub-frame members 54 may be replaced with or supplemented by any of various types of filters or diffraction gratings to produce desired visual effects.

The controller 50 includes a plurality of switches and controls which control the sequence and timing of the input control signals from the interface device 48 to the laser drivers 32–46. These switches and controls may be set to produce a number of visual effects.

Figure 2:
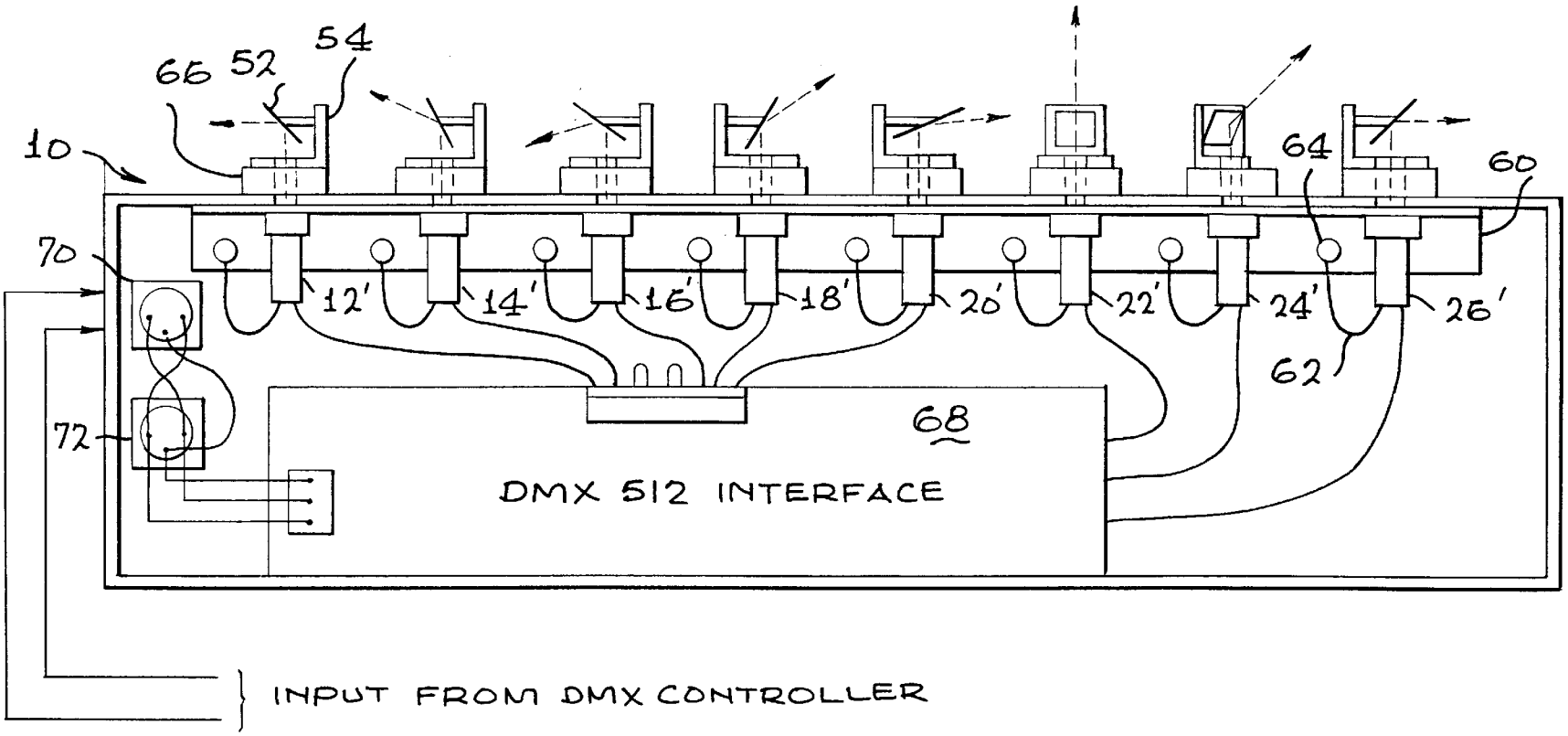
FIG. 2 is a simplified plan view of the projector of FIG. 1.

FIG. 2 is a simplified plan view of the projector 10 with the cover removed. The frame 11 is in the form of a shallow, elongated, rectangular housing, which may be of anodized aluminum. The laser units 12', 14' 10', 18', 20', 22', 24', and 26' are secured to an elongated aluminum member 60 which provides stiffness for mounting the laser units and also provides a ground line. Each of the laser units is grounded to member 60, e.g., laser unit 26' is connected to member 60 by means of a wire 62 and a self-tapping screw 64. In the present embodiment, each laser unit includes the driver unit for its respective laser; however, separate driver circuits may be used.

As shown above, each of the identical sub-frame members 54 includes an adjustable mirror 52 which is actually secured to a block 66, which includes a window through which the laser light beam passes before impinging on mirror 52. As shown in FIG. 2, sub-frame members 54 may be oriented in a number of different directions to direct the laser light beams as desired.

The DMX-512 interface comprises essentially a printed circuit board 68 having connections to each of the laser units 12' and 26' as shown. Circuit board 68 is secured to and spaced from frame 11 in such a way as to avoid having any of the connections on its underside come in contact with frame 11. Input signals from the DMX Controller 50 are connected through connectors 70 and 72 to interface 68.

Figure 3:
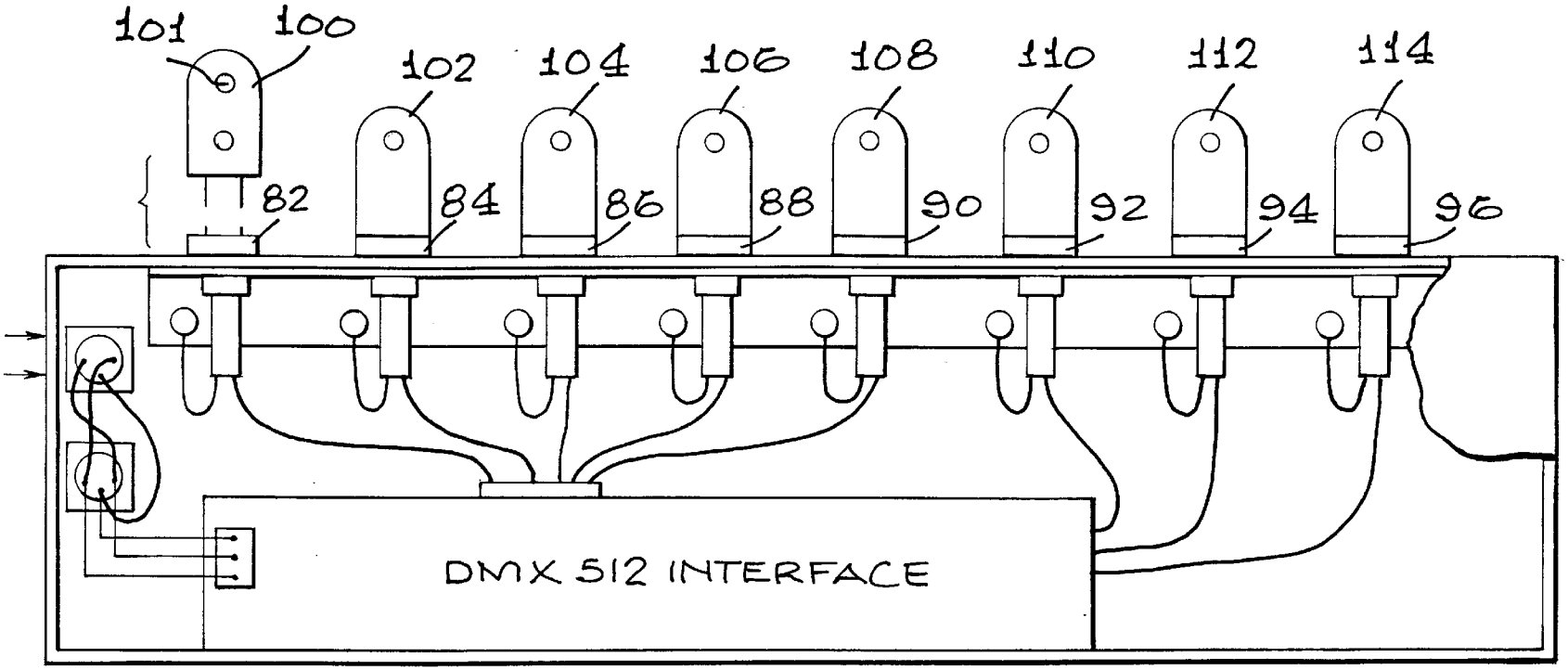
FIG. 3 is a block diagram of another embodiment of the invention.

FIG. 3 is a block diagram of another embodiment of my invention. This embodiment is very similar to that of FIGS. 1 and 2, but rather than fixing the laser modules into the frame 11 as shown in FIG. 2, the housing 80 of FIG. 3, which contains the power supply, the DMX-512 interface board 68 and various other connections, includes a plurality of connectors 82, 84, 86, 88, 90, 92, 94, and 96, each of which is designed to receive a plug-in laser module. Each module includes a laser diode with its driver and may also include a deflecting member 54 and mirror 52 (see FIGS. 1 and 2). Alternatively, a deflecting member and mirror (and/or lens such as a diffraction grating) may be separately secured to the module.

Module 100 is shown with an output aperture 101 and detached from connector 82 to indicate that it is a plug-in unit. Other modules 102, 104, 106, 108, 110, 112, and 114 are shown plugged into the remaining connectors.

With the above described embodiment, the housing 80 has been referred to as a "docking unit" since various numbers and types of laser units can be plugged into the connectors in housing 80. This embodiment enables the user to select among laser units of varying colors, or of those having different kinds of filters and plug in as many or as few as desired. To reduce the initial investment, a purchaser could start with a limited number of low-powered, low-cost laser modules and then, as desired, add higher powered, multi-colored, more expensive laser modules.

The above-described embodiments of the present invention are merely descriptive of its principles and are not to be considered limiting. The scope of the present invention instead shall be determined from the scope of the following claims including their equivalents.

I claim:

1. A laser light system comprising:

a housing;

a plurality of mirrors operatively connected to said housing for receiving laser light beams;

a plurality of laser diodes for directing laser light beams against said mirrors; and a controller operatively connected to said laser diodes for controlling the timing and sequence of said light beams.

2. A laser as claimed in claim 1 wherein some of said laser diodes produce light beams of different colors from light beams of other said laser diodes.

3. A laser light system as claimed in claim 1 wherein at least some of said mirrors are adjustable relative to said housing to vary the direction of said laser light beams.

4. A laser light system comprising:

a housing;

a plurality of laser diodes mounted on said housing, and driver circuits for each of said laser diodes;

control circuits in said housing connected to each of said driver circuits;

a controller connected to said control circuits for controlling the timing of laser light beams from each individual laser diode; and a plurality of mirrors secured to said housing in alignment with said laser diodes and at least some of said mirrors being adjustable relative to said housing to vary the direction of said laser light beams.

5. A laser light system as claimed in claim 4 wherein at least one of said laser diodes produces a light beam of a different color from light beams of other said laser diodes.

6. A laser light system as claimed in claim 4 wherein laser light modifying means other than said mirrors are secured to at least one of said modules.

7. A laser light system comprising:

a housing;

a plurality of laser diodes mounted on said housing, and driver circuits for each of said laser diodes;

control circuits in said housing connected to each of said driver circuits;

a controller connected to said control circuits for controlling the timing of laser light beams from each individual laser diode; and said housing includes a plurality of apertures, each of said laser diodes is mounted to direct laser light through one of said apertures, a sub-frame member is positioned over each of said apertures and a mirror is carried on at least some of said sub-frame members for deflecting said laser light beams as desired.

8. A laser light system as claimed in claim 7 wherein at least some of said mirrors are adjustable to vary the direction of the laser light beams reflected from said mirrors.

9. A laser light system as claimed in claim 7 wherein each of said mirrors is mounted in a sub-frame member secured to said housing and at least some of said sub-frame members are movable to different positions to vary the direction of said laser light beams.

10. A laser light system as claimed in claim 7 wherein some of said laser diodes produce light beams of different colors from light beams of other said laser diodes.

11. A laser light system comprising:

a housing having a plurality of apertures along one side and electrical connectors secured in said apertures;

control circuits in said housing connected to said electrical connectors; and a plurality of plug-in modules attachable to said connectors, said modules each including a laser diode and a driver circuit.

12. A laser light system as claimed in claim 11 wherein laser light deflecting means are secured to said modules.

13. A laser light system including a housing having a plurality of apertures, a plurality of mirrors mounted on said housing for receiving laser light beams through said apertures and deflecting said light beams, means for supplying laser light beams to said mirrors, and a controller for controlling the timing and sequence of said light beams;

characterized in that said means for supplying laser light beams to said mirrors comprises a plurality of separate laser diodes, each supplying a laser light beam through one of said apertures.

* * * * *